United States Patent [19]

Lundström

[11] Patent Number: 4,555,306

[45] Date of Patent: Nov. 26, 1985

[54] METHOD AND MEANS FOR REMOVING WATER FROM A WEB IN A PRESS OF A PAPERMAKING MACHINE

[75] Inventor: Kristian Lundström, Soljala, Finland

[73] Assignee: Tamfelt Oy Ab, Finland

[21] Appl. No.: 653,815

[22] Filed: Sep. 24, 1984

[30] Foreign Application Priority Data

Oct. 3, 1983 [FI] Finland ..... 833583

[51] Int. Cl.[4] ..... D21F 3/02; D21F 3/06; D21F 1/10

[52] U.S. Cl. ..... 162/205; 100/118; 162/358; 162/DIG. 1

[58] Field of Search ..... 162/205, 274, 275, 276, 162/358, 360.1, DIG. 1; 100/118, 153

[56] References Cited

U.S. PATENT DOCUMENTS 3,214,326 10/1965 Lee ..... 162/205
3,528,883 9/1970 Lundin ..... 162/360.1

FOREIGN PATENT DOCUMENTS 55206 6/1982 European Pat. Off. ..... 162/358
3147115 6/1983 Fed. Rep. of Germany .
823265 3/1983 Finland .
822731 7/1983 Finland .
457766 2/1975 U.S.S.R. ..... 162/358

*Primary Examiner*—William F. Smith
*Assistant Examiner*—K. M. Hastings
*Attorney, Agent, or Firm*—Scully, Scott, Murphy & Presser

[57] ABSTRACT

The invention relates to a method and means for removing water from a web in a press of a papermaking machine. The web to be dried is passed between press felts through a press nip formed between press rolls. A resilient mat or the like, which is in contact with one of the press felts, is also passed through the press nip. In order to produce a hydraulic counterpressure at the nip, a wire is passed between the resilient mat and one of the press rolls and water is sprayed on the wire immediately before the press nip for producing a water cushion in the section of the wire lying between the press roll and the resilient mat. The wire is in this case formed so that water cannot move in the longitudinal or vertical direction of the wire.

12 Claims, 6 Drawing Figures

Figure 1:
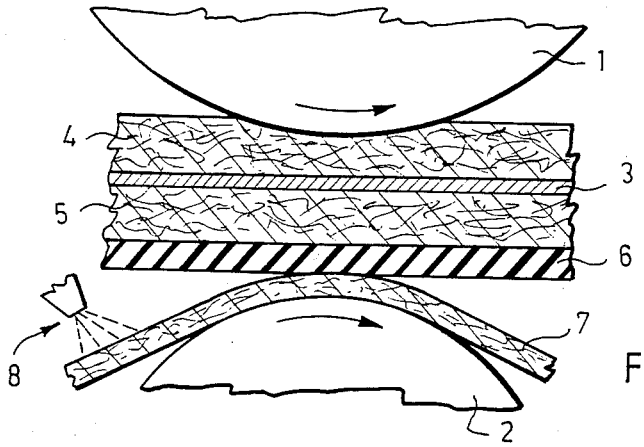

METHOD AND MEANS FOR REMOVING WATER FROM A WEB IN A PRESS OF A PAPERMAKING MACHINE

The invention relates to a method for removing water from a web in a press of a papermaking machine, wherein the web to be dried is passed between press felts through a press nip formed between press rolls and wherein a resilient mat or the like is also passed through the press nip, said mat being in contact with one of the felts. The invention also relates to means for carrying out the aforesaid method.

The invention is intended to be used in the press section of a papermaking machine, with the purpose of producing the fastest possible increase in compressive pressure at the nip. The invention is best applied to extended nip presses, in which the nip extension is achieved by means of a resilient mat employed in addition to the felts. The resilient mat can be an endless mat made of e.g. a polyurethane with a textile fabric reinforcement.

The distribution of compressive pressure at the nip is of very great importance with regard to water removal from the web. The faster the compressive pressure can be made to reach its maximum point, the higher will be the efficiency of water removal from the wet web. Another factor which improves water removal is that the compressive pressure remains at or at least near the maximum. This depends essentially on the length of the nip, and it is this aspect that makes the present invention particularly advantageous for use in extended nip presses.

Increasing the pressure as rapidly as possible at the entrance of the nip is very desirable but cannot be accomplished by prior art solutions. In the prior art, a plastic wire has been employed, for instance, in wire presses. This plastic wire has been used to form a surface with voids in order to provide the shortest possible route for water transfer from the felt into the voids in the wire.

Another prior art press employing a plastic wire is a so-called sleeve press. In this type of press the plastic wire that forms the surface with voids is stretched on the roll. The principle of operation is similar to that of the above example; water is efficiently transferred into the voids in the wire, from which it is removed in a manner known in the art, for instance, by means of an air knife.

These two solutions have the disadvantage that they cannot be used to increase the pressure at the nip faster than by conventional means, because the water quickly passes into the meshes of the wire, i.e. the hydraulic pressure is released into the wire.

It is an object of the invention to provide a method and means for improved water removal from a web.

The basic principle of the invention is to utilize the hydraulic counterpressure acting immediately at the beginning of the pressing stage.

This is achieved by the method according to the invention, which is characterized in that a wire is passed between the resilient mat and one of the press rolls through the press nip and that water is sprayed on said wire immediately before the press nip in order to produce a water cushion in the section of the wire lying between the press roll and the resilient mat.

The method according to the invention can be used to increase the compressive pressure very rapidly. This is due to the following fact. When the saturated wire enters the nip, the water cannot flow out of the wire during pressing, because there is a water-impermeable resilient mat on the wire. Mechanical compression therefore becomes effective very quickly, because a counterpressure is created by the incompressible water. Consequently, the compressive pressure at the nip reaches its maximum very quickly.

Another object of the invention is means, i.e. a wire, for accomplishing the method. The wire according to the invention is characterized in that, in order to produce a water cushion in the section of the wire lying between one of the press rolls and the resilient mat, the wire is provided with voids known per se, and that in the vertical direction of the wire there are cross-direction weft yarns disposed close to one another and arranged to prevent water which is sprayed on the wire immediately before the press nip and which fills the voids from moving in the wire in the direction of the wire at the press nip. Other preferred embodiments of the wire according to the invention are described herein. By using the wire according to the invention, the water sprayed on the wire can be retained in place with sufficient efficiency for creating at the nip a water cushion that provides the aforementioned counterpressure.

Figure 2:
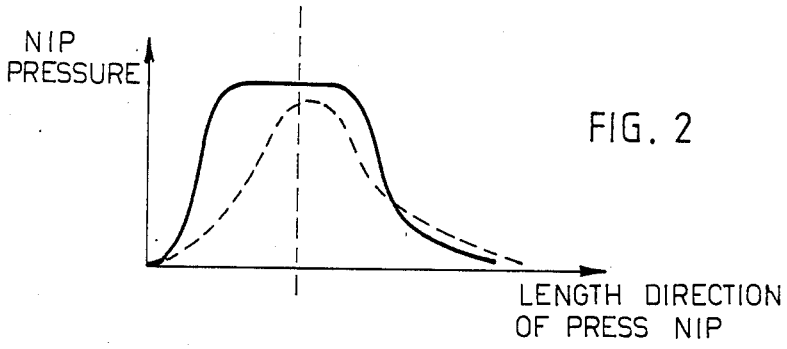
Figure 3:
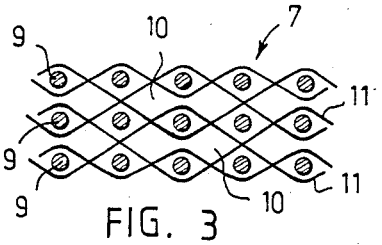
Figure 4:
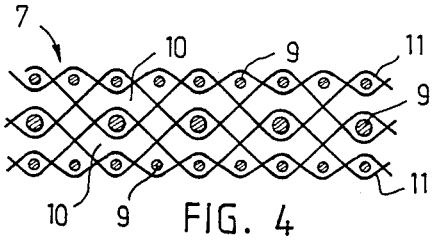
Figure 5A:
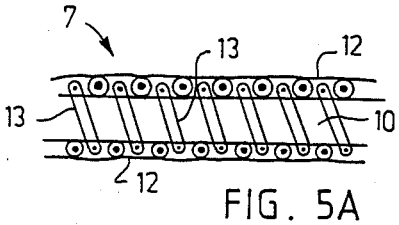
Figure 5B:
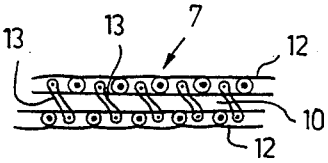

The invention will now be described in more detail with reference to the examples illustrated in the accompanying drawings, FIG. 1 is a schematic side view of a device employing the method according to the invention, FIG. 2 is a schematic diagram of the pressure distribution at the nip, FIG. 3 is a schematic cross-sectional view of an embodiment of the wire according to the invention, FIG. 4 illustrates another embodiment of the wire according to the invention, and FIGS. 5A and 5B illustrates a third embodiment of the wire according to the invention.

FIG. 1 shows schematically the press device of a papermaking machine. The press rolls are designated by the reference numerals 1 and 2. The web to be dried is designated by the reference numeral 3, and the felts by the reference numerals 4 and 5. The resilient mat that is in contact with one of the felts is designated by the reference numeral 6.

The press rolls 1, 2 of the press device illustrated in FIG. 1 are rotated in the directions indicated by the arrows, whereupon the web 3 to be dried, the felts 4, 5 and the resilient mat move through the nip from left to right in FIG. 1. During the pressing stage the web is in a conventional manner between the two felts, which receive water expressed from the web and convey it out of the nip.

According to the invention, a wire 7 is passed between the resilient mat 6 and one of the press rolls. Furthermore, water is sprayed on this wire immediately before the nip so that the wire 7 becomes completely saturated. In this context the term "saturated" means that the voids in the wire are filled with water. For example, the openings between weft and warp yarns may be regarded as voids. In the Figure the spraying of water is indicated generally by the reference numeral 8. Water may, of course, be sprayed in many different ways; what is important is that the wire 7 becomes completely saturated. Accordingly it is preferable that water is sprayed on the wire 7 over the entire width of the wire.

Due to the water sprayed on the wire 7, a hydraulic counterpressure is produced at the press nip, whereby the compressive pressure at the nip rises very rapidly up to its maximum point. This is particularly apparent from FIG. 2, in which the solid line depicts the distribution of the compressive pressure in the machine direction of the nip when a device employing the method according to the invention is used. For comparison, FIG. 2 also shows the distribution of the compressive pressure indicated by a dashed line when the method according to the invention is not utilized. The rate of increase in the compressive pressure is substantially better when the present invention is utilized.

In the method according to the invention the resilient mat 6 has, besides the task of extending the length of the nip in a manner known per se, the additional task of preventing the removal of water sprayed in the wire. The resilient mat 6 must therefore be completely impermeable, i.e no water must get through the mat even at high compressive pressures. The resilient mat 6 may, for example, be produced by filling a fabric reinforcement with an elastomer such as a polyurethane. As the resilient mat 6 and the surface of the press roll are completely impermeable, the water sprayed forms a cushion which serves to create the above-mentioned hydraulic counterpressure at the nip, whereby the compressive pressure will reach its maximum very quickly.

It is furthermore obvious that the wire 7 should be so constructed that the water sprayed therein will not, upon compression, move backwards with respect to the direction of movement of the wire, for example, in the case of FIG. 1 to the left, so that the water does not enter the nip but remains in front of the nip. The wire should correspondingly be such that water removal through the outer and inner surfaces is as slow as possible. Therefore it is an essential feature of the invention that the structure of the wire 7 is formed in a certain manner.

An embodiment of the wire 7 according to the invention is shown in a schematic and greatly enlarged form in FIG. 3. According to FIG. 3, the wire 7 consists of a plurality of cross-direction weft yarns 9 positioned one on top of another as closely as possible, leaving therebetween voids 10, which convey water sprayed on the wire 7. The cross-direction weft yarns 9 placed one on top of another prevent the water sprayed on the wire from moving forwards or backwards in the direction of the wire. The wire shown in FIG. 3 has three layers, but it is obvious that this is not the only number of layers that can be used; other constructions are also possible. In the schematic FIG. 3 the warp yarns are designated by the reference numeral 11.

Another embodiment of the wire 7 according to the invention is illustrated in FIG. 4. The same reference numerals as in the embodiment of FIG. 3 are used for the cross-direction weft yarns and for the machine-direction warp yarns. In the embodiment shown in FIG. 4, the outer surface and the inner surface of the wire (in the Figures, upper and lower surface respectively) have a closer weave construction than the middle section of the wire 7. The wire therefore contains voids 10, which convey water sprayed on the wire. This construction serves to impede the removal of water from the wire through the outer and inner surfaces, while providing a sufficient void volume inside the wire for creating (when filled with water) the aforesaid hydraulic counterpressure.

A preferred embodiment of the wire 7 according to the invention can be obtained by combining the solutions described in the above examples. Such an embodiment prevents the removal of water from the wire either in the machine direction or in the vertical direction (upwards and downwards in the Figures). To accomplish such an embodiment, for example, a thin, water-impremeable layer made of e.g. polyurethane can be provided on one side of the wire shown in FIG. 3. In this case the water is sprayed on the open side of the wire.

A preferred embodiment of the wire 7 according to the invention is illustrated in FIGS. 5A and 5B. The wires shown in FIGS. 3 and 4 are only slightly compressible, but as they are saturated at the nip, even a slight compression will cause a hydraulic counterpressure in the nip. In the embodiment shown in FIG. 5A the compressibility has been made higher. This embodiment comprises two spiral wires 12 interconnected by means of joining spirals 13. The joining spirals allow the spiral wires 12 to approach one another during the pressing stage as shown in FIG. 5B, and when the pressing ceases, the distance between the spiral wires 12 automatically returns to its original value. A sufficient void volume 10 is also left between the spiral wires 12 for producing the hydraulic counterpressure.

The above examples are by no means intended to limit the invention; the invention may of course be modified in many ways within the scope of the claims. Thus the wire 7 need not be a separate endless wire but may be fitted as a sleeve on one of the press rolls. The wire 7 may also be passed around the upper roll, whereby the resilient mat 6 is in contact with the top surface of the upper felt 4 (FIG. 1). The resilient mat and one of the felts may also be combined to form a single component by coating that surface of said press felt which is remote from the web 3, for instance with polyurethane or the like.

I claim:

1. A method for removing water from a web in a press of a papermaking machine comprising:

passing a web to be dried between two press felts through a press nip formed between two press rolls:

passing a resilient water-impermeable mat through the press nip, said mat being in contact with one of the press felts;

passing a wire between the resilient mat and one of the press rolls through the press nip, said wire being in contact with said mat and said one of the press rolls at the press nip;

spraying water on said wire immediately before the press nip so that the wire becomes completely saturated; and retaining said water in voids formed by weft and warp yarns within said wire that prevent water from moving in the direction of movement of the wire as the wire passes through said press nip thereby providing a water cushion in the section of the wire lying between the press roll and the resilient mat.

2. A method as claimed in claim 1 wherein the water is sprayed on the wire over the entire width of the wire.

3. A wire in combination with a press of a papermaking machine, said press having a press nip formed between two press rolls and a web to be dried located between two press felts together with a resilient water-impermeable mat in contact with one of the press felts, means for passing said web, felts, and mat through the press nip, means for passing said wire between the mat and one of the press rolls, said wire being in contact with the mat and said one of the press rolls at the press nip and a means for spraying water on said wire located immediately before said press nip, said wire comprising warp yarns arranged along the longitudinal direction of the wire; and cross-direction weft yarns arranged substantially perpendicular to the warp yarns thereby forming voids that retain water whereby as said wire is passed through said press nip water is prevented from moving in the direction of movement of the wire, thereby producing a water cushion in the section of the wire lying between the press roll and the resilient mat.

4. The combination as claimed in claim 3, wherein at least one of the surfaces of the wire has a closer weave construction than the middle section of the wire, the denser surface portions being arranged to prevent the water present in the middle section of the wire from escaping from the wire in a vertical direction with respect to the wire.

5. The combination as claimed in claim 3, wherein one of the surfaces of the wire is provided with a water-impermeable layer.

6. The combination as claimed in claim 3, wherein the wire is composed of two spiral wires which are interconnected by means of joining spirals.

7. The combination as claimed in claim 3, wherein the wire is placed as a sleeve around one of the press rolls.

8. The combination as claimed in claim 4, wherein the wire is composed of two spiral wires which are interconnected by means of joining spirals.

9. The combination as claimed in claim 5, wherein the wire is composed of two spiral wires which are interconnected by means of joining spirals.

10. The combination as claimed in claim 4, wherein the wire is placed as a sleeve around one of the press rolls.

11. The combination as claimed in claim 5, wherein the wire is placed as a sleeve around one of the press rolls.

12. A wire as claimed in claim 6, wherein the wire is placed as a sleeve around one of the press rolls.

* * * * *